US005893344A

United States Patent [19]

Church

[11] Patent Number: 5,893,344

[45] Date of Patent: Apr. 13, 1999

[54] VALVE DEACTIVATOR FOR PEDESTAL TYPE ROCKER ARM

[75] Inventor: Kynan L. Church, Ceresco, Mich.

[73] Assignee: Eaton Corporation, Cleveland, Ohio

[21] Appl. No.: 09/114,739

[22] Filed: Jul. 13, 1998

[51] Int. Cl.[6] ..... F02D 13/06

[52] U.S. Cl. ..... 123/90.16; 123/90.43; 123/198 F

[58] Field of Search ..... 123/90.15, 90.16, 123/90.39, 90.41, 90.43, 198 F

[56] References Cited

U.S. PATENT DOCUMENTS

| | | | |
|---|---|---|---|
| 4,213,442 | 7/1980 | Mihalic | 123/198 F |
| 4,221,199 | 9/1980 | Buuck et al. | 123/90.16 |
| 4,221,200 | 9/1980 | Soeters, Jr. | 123/90.16 |
| 4,221,201 | 9/1980 | Soeters, Jr. | 123/90.16 |
| 4,256,070 | 3/1981 | Mueller | 123/198 F |
| 4,262,640 | 4/1981 | Clark | 123/90.43 |
| 4,305,356 | 12/1981 | Walsh | 123/198 F |
| 4,380,219 | 4/1983 | Walsh | 123/198 F |
| 4,469,061 | 9/1984 | Ajiki | 123/198 F |

*Primary Examiner*—Weilun Lo
*Attorney, Agent, or Firm*—L. J. Kasper

[57] ABSTRACT

A valve deactivator assembly (43) for an internal combustion engine. The deactivator assembly (43) is of the type having a two-stage latchable means (49) movable between a latched (FIG. 3) position, effecting normal valve opening and closing, and an unlatched (FIG. 4) position, in which valve opening and closing may either be reduced or eliminated. The deactivator assembly (43) includes a rotatable latch member (69) which is rotated between the latched and unlatched positions by a electromagnetic actuator (51), including a rotatable armature (75) which is fixed to rotate with the latch member (69). With the arrangement of the invention, having no linkage, and very little inertia, movement between the latched and unlatched positions can occur during a single revolution of the engine cam shaft.

11 Claims, 5 Drawing Sheets

VALVE DEACTIVATOR FOR PEDESTAL TYPE ROCKER ARM

CROSS-REFERENCE TO RELATED APPLICATIONS

Not Applicable

STATEMENT REGARDING FEDERALLY SPONSORED RESEARCH OR DEVELOPMENT

Not Applicable

MICROFICHE APPENDIX

Not Applicable

BACKGROUND OF THE DISCLOSURE

The present invention relates to an improved valve train for an internal combustion engine, and more particularly, to a valve deactivator assembly for use therein.

Although the valve deactivator assembly of the present invention may be utilized to introduce some additional lash into the valve train, such that the valves open and close by an amount less than normal, the invention is especially suited for introducing into the valve train sufficient lash such that the valves no longer open and close at all, and the invention will be described in connection therewith.

Valve deactivators of the general type to which the invention relates are known, especially in connection with internal combustion engines having push rod type valve train in which there is a rocker arm, with one end of the rocker arm engaging a push rod, and the other end engaging the engine poppet valve. Typically, a central portion of the rocker arm is fixed relative to the cylinder head by a fulcrum arrangement as is well known to those skilled in the art, in which the fulcrum normally prevents movement in an "up and down" direction, while permitting the rocker arm to engage in cyclic, pivotal movement, in response to the cyclic motion of the push rod, which results from the engagement of the push rod with the lobes of the rotating cam shaft.

Examples of known valve deactivator assemblies are shown and described in U.S. Pat. Nos. 4,221,199; 4,256,070; 4,305,356; and 4,380,219, all of which are assigned to the assignee of the present invention, and incorporated herein by reference. The valve deactivators of the above incorporated patents have typically involved some sort of latch member which is movable (typically, rotatable, but in some cases, movable linearly) between a latched position and an unlatched position. The movement of the latch member conventionally occurs is response to linear movement of a linear actuator, by means of an appropriate linkage arrangement.

Although the prior art valve deactivators have operated in a generally satisfactory manner, the actuator arrangement, including the required linkage, has resulted in an unacceptably slow response time, thus limiting the ability of the arrangement to be operated by the engine microprocessor, in synchronism with various other engine systems. The prior art devices typically had a response time, from "ON" to "OFF", or vice versa, in the range of about 100 to 200 milliseconds In modern internal combustion engines, utilizing fuel injection, it is especially desirable in a valve deactivator system to turn off the fuel injectors at the same time that the operation of the valves is stopped. However, the fuel injectors are electrically actuated, and can be turned off almost instantaneously, and therefore, it is desirable to be able to activate the valves and turn on the fuel injectors, or deactivate the valves and turn off the fuel injectors, within the ensuing, single revolution of the engine cam shaft. Thus, and by way of example only, in developing the present invention, the goal for the valve deactivator system was a maximum time under 25 milliseconds from "ON" to "OFF", or vice versa.

In addition, the actuator and linkage arrangements used in the prior art devices have resulted in an excessive number of parts, increasing the overall cost of the system. Finally, the actuator and linkage arrangements have typically taken up enough space to limit the packaging options in the engine cylinder head.

BRIEF SUMMARY OF THE INVENTION

Accordingly, it is an object of the present invention to provide an improved valve deactivator assembly which overcomes the above-described disadvantages of the prior art.

It is a more specific object of the invention to provide an improved valve deactivator assembly having substantially reduced response time, such that the assembly may change from "ON" to "OFF", or vice versa, within one revolution of the engine cam shaft.

It is a related object of the present invention to provide an improved valve deactivator system having a substantially reduced amount of linkage, and wherein the movable portion of the assembly has a minimum amount of inertia.

The above and other objects of the invention are accomplished by the provision of an improved valve deactivator assembly for an internal combustion engine of the type having valve means for controlling the flow to and from a combustion chamber, drive means for providing cyclical motion for opening and closing the valve means in timed relationship to the events in the combustion chamber, and valve gear means operative in response to the cyclic motion to effect cyclic opening and closing of the valve means. The valve deactivator assembly is of the type having a two-state latchable means movable between a latched position and an unlatched position, and operative in the latched position to provide normal predetermined opening and closing of the valve means. The assembly is operative in the unlatched position to effect lost motion of the valve gear means and effect opening and closing of the valve means by a predetermined amount which is less than the normal, predetermined opening and closing. The valve deactivator assembly includes a latch member rotatably movable between the latched and the unlatched positions.

The improved valve deactivator assembly is characterized by the assembly including an electromagnetic actuator having a stationary electromagnetic coil operable to generate magnetic lines of flux, a stationary pole piece, and a rotatable armature operable to rotate under the influence of the magnetic lines of flux. The rotatably movable latch member is fixed to rotate with the rotatable armature.

DETAILED DESCRIPTION OF THE PREFERRED EMBODIMENT

Figure 1:
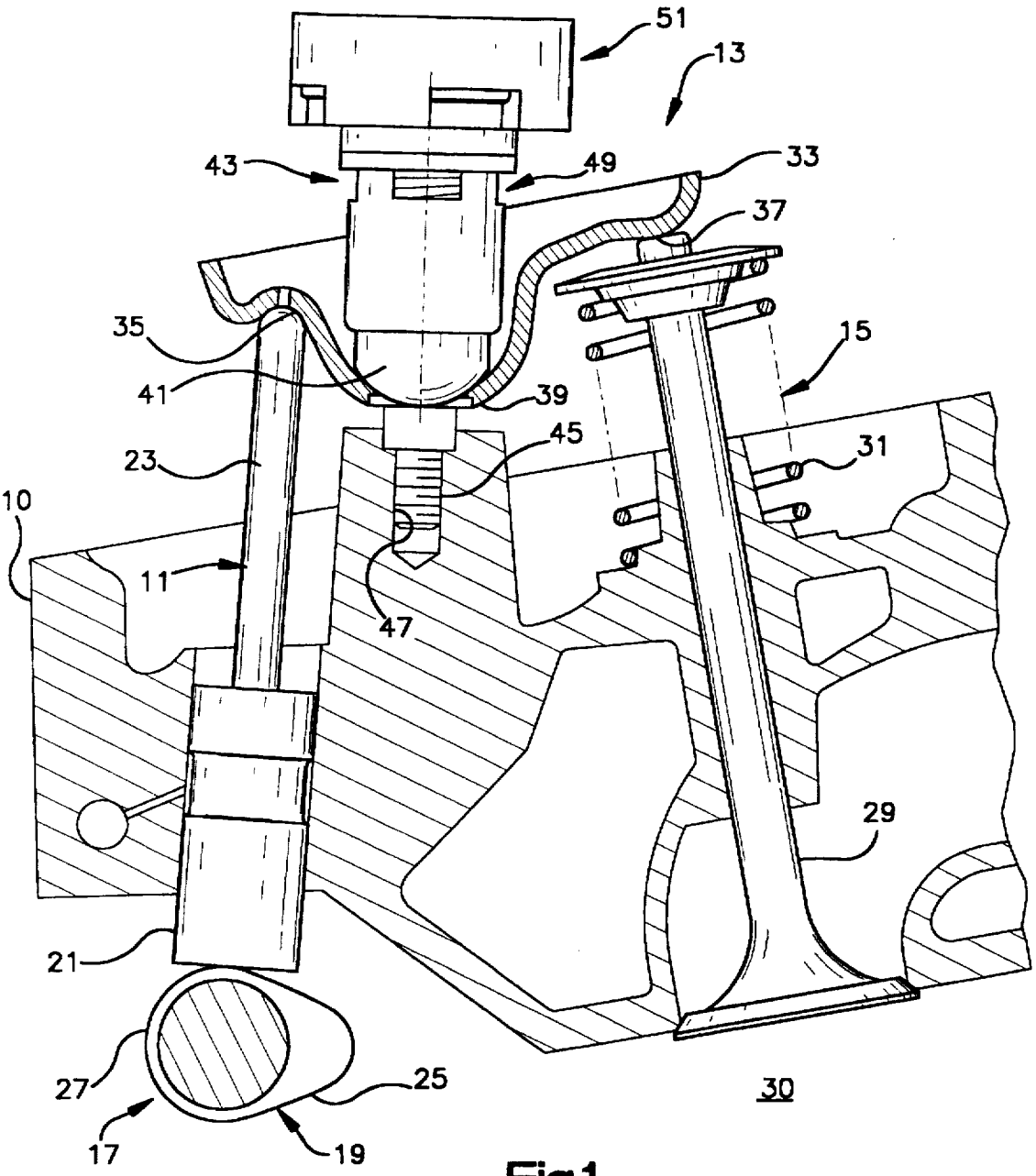
FIG. 1 is a fragmentary, axial cross-section taken through the cylinder head of a vehicle internal combustion engine, illustrating the valve deactivator mechanism of the present invention in external plan view.

Referring now to the drawings, which are not intended to limit the invention, FIG. 1 illustrates a valve actuating drive train of the push rod type, although it should be understood that the use of the present invention is not so limited. The valve drive train includes a cylinder head 10 on which are mounted a conventional drive assembly 11, a rocker arm assembly 13, and an engine poppet valve assembly, generally designated 15.

The drive assembly 11 includes a camshaft 17 having a cam 19, a hydraulic lifter 21, and a push rod 23. The cam 19 includes a lift portion 25 and a dwell (base circle) portion 27. The valve assembly 15 includes a poppet valve 29, operable to control flow into or out of a combustion chamber 30, and a spring 31 which biases the valve 29 toward the closed position shown in FIG. 1, as is well known to those skilled in the art.

The rocker arm assembly 13 includes a rocker arm 33 of the individually pivoted type, the rocker arm 33 including one end 35 which is adapted to receive input, cyclic motion from the push rod 23, and another end 37 which is adapted to transmit to the valve 29 the cyclic motion of the push rod 23. As a result, the engine poppet valve 29 has a cyclic opening and closing motion, corresponding to that of the push rod 23. During normal engine operation, the only motion of the rocker arm 33 is its pivotal movement, with the ends 35 and 37 engaging in alternating up and down movement.

The rocker arm 33 includes a pivot portion 39, disposed intermediate the ends 35 and 37, and a fulcrum 41 is disposed within the pivot portion 39, in a manner which permits the rocker arm 33 to pivot, as described previously. The fulcrum defines a pair of internal flat surfaces 42, the function of which will be described subsequently. Disposed above the fulcrum 41 is a valve deactivator assembly, generally designated 43, having a threaded mounting bolt 45 extending through the assembly 43 and being in threaded engagement with an internally threaded bore 47 defined by the cylinder head 10.

Typically, the present invention would be utilized with an eight cylinder engine, for which the valve drive train would include two pairs of intake and exhaust valve rocker arms equipped with the valve deactivator assembly 43, as shown in FIG. 1, on each of the cylinder heads 10. In other words, four of the eight cylinders can be selectively deactivated by introducing sufficient "lost motion" into the drive train for that particular valve so that the cyclic motion of the push rod 23 does not result in any corresponding cyclic opening and closing movement of the poppet valve 29. More specifically, the lost motion is introduced into the drive train at the pivot portion 39 of the rocker arm 33, by means of the valve deactivator assembly 43. Although not an essential feature of the invention, it is preferred that the valve deactivator assembly operate by permitting lost motion of the central, pivot portion 39 of the rocker arm 33, such that cyclic motion of the push rod 23 merely pivots the rocker arm about the end 37 which is in engagement with the valve 29, but without causing any opening or closing motion of the valve.

In accordance with one important aspect of the present invention, the valve deactivator assembly 43 includes a valve deactivator portion 49 and an actuator portion 51, wherein the actuator portion 51 is mounted "on top" of the valve deactivator portion 49, rather than being separated therefrom by some sort of linkage arrangement. Those skilled in the art will understand that, as used herein, terms like "above" and "on top", and terms of similar import are used to specify general relationships between parts, and not necessarily to indicate orientation of the part or of the overall assembly.

Referring now primarily to PIG. 2, the valve deactivator assembly 43 will be described in some detail. Surrounding the mounting bolt 45 is a generally cylindrical sleeve or shaft 53 including an enlarged head portion 55, disposed at the upper end of the shaft 53. Toward the lower end of the shaft 53 is a clip 57, engaging the outside diameter of the shaft 53 and limiting relative downward movement of the fulcrum 41. The shaft 53 includes a pair of oppositely disposed flat surfaces 58 (see FIGS. 3 and 4), the function of which is to engage the mating flat surfaces 42 on the fulcrum 41 and achieve proper rotational alignment of the shaft 53 to the fulcrum 41, and of the fulcrum to the cylinder head 10. The flat surfaces 58 also help to insure proper relative alignment of the portions 49 and 51.

Disposed above the fulcrum 41 and in engagement therewith is a body member 61. The body member 61 is generally cup-shaped (a "crenelated cup"), including a plurality of upwardly-extending tabs 63 (best seen in FIGS. 3 and 4). Disposed within the body member 61 is a helical compression spring 65, one function of which is to maintain an upward biasing force on a cylindrical, generally L cross-section cage member 67. The cage member 67 and the underside of the head portion 55 cooperate to define a vertical clearance, and disposed therein is a circular latch plate 69. Another function of the spring 65 is to "control" the lash adjuster 21, as will be explained in greater detail subsequently. As may best be seen in FIGS. 3 and 4, the latch plate 69 defines an array of arcuate openings 71, the openings 71 corresponding in number and configuration to the tabs 63.

Figure 3:
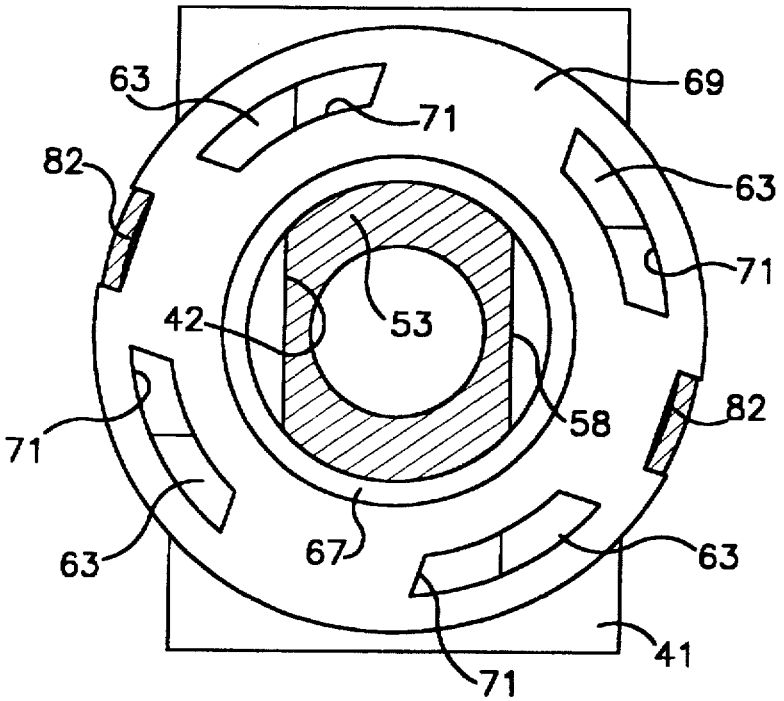
FIG. 3 is a transverse cross-section of the valve deactivator of the present invention, taken on line 3—3 of FIG. 2, in its normal, latched condition.
Figure 4:
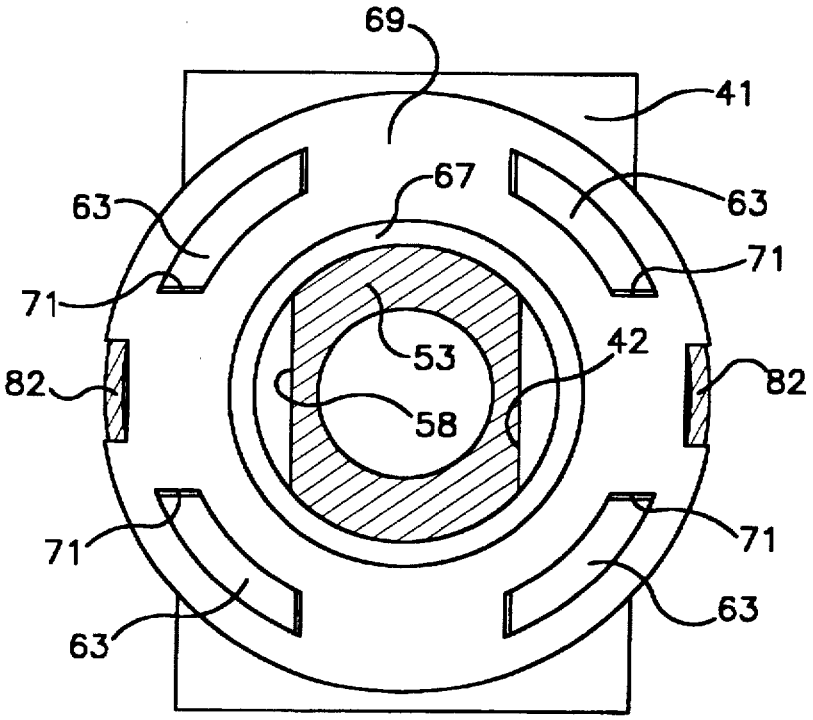
FIG. 4 is a transverse cross-section, similar to FIG. 3, but with the valve deactivator in its unlatched condition.

In accordance with one important aspect of the invention, when it is desired to move the valve deactivator portion 49 between the latched condition of FIG. 3 and unlatched condition of FIG. 4, the only part of the deactivator portion 49 which is required to move is the latch plate 69 and, in the subject embodiment, the latch plate 69 simply rotates about 20 degrees (counterclockwise from FIG. 3 to FIG. 4) in changing between the latched and unlatched conditions. Also, because the thickness (in the vertical direction) of the latch plate 69 is less than the height of the clearance between the head portion 55 and the cage member 67, there is no frictional preload on the latch plate 69, nor any other source of inertia. Thus, it is possible to move the latch plate 69 between the latched and unlatched conditions very quickly, and with relatively little torque being required for either direction of rotation of the latch plate 69.

By way of example only, in the subject embodiment, the clearance ("mechanical lash") surrounding the latch plate 69, in the latched mode, is about 0.05 mm. The precise control of this small amount of lash may be achieved by select fitting components such as the fulcrum 41; the sleeve 53; the clip 57; the body member 61; and the latch plate 69. As was alluded to previously, the lash is controlled or maintained in the above assembly of parts by the spring 65, which exceeds the combined effect of the plunger spring of the lash adjuster 21 and the oil pressure on the lash adjuster plunger. In other words, the force of the spring 65 prevents the lash adjuster 21 from taking up all of the lash around the latch member 69, which would result in the member 69 being squeezed, rather than being free to rotate.

The clip 57 provides a stop which prevents the lost motion spring 65 from completely compressing the lash adjuster 21 once the required amount of lash is obtained. The clip 57 also allows the lash adjuster 21 to compensate for lash external to the deactivator, caused by valve train assembly tolerances, wear and differential thermal expansion.

Referring again to FIG. 2, is also an important feature of the invention that when the deactivator portion 49 is in the latched condition, as is the case in FIGS. 2 and 3, the height of the body member 61 is selected such that the tabs 63 are not in engagement with the underside of the latch plate 69, but instead, are spaced apart slightly from the underside of the latch plate 69. However, as will be understood by those skilled in the art, it is important that the vertical spacing from the underside of the latch plate 69 to the upper surface of the tabs 63 be very small, perhaps on the order of about 0.1 mm. to about 0.2 mm.

Figure 7:
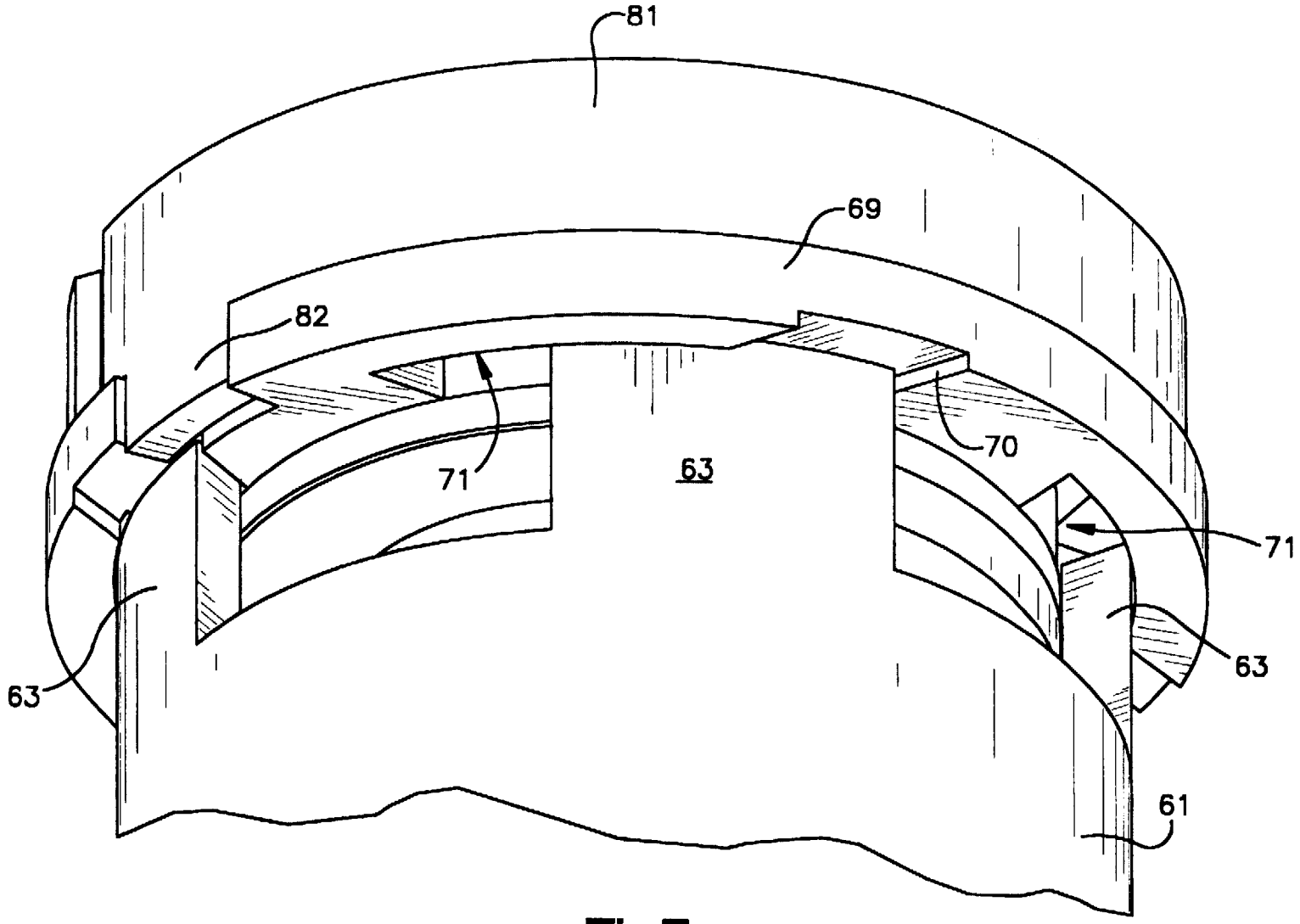
FIG. 7 is a fragmentary, perspective view of one portion of the valve deactivator, in its latched condition, illustrating one aspect of the invention.

Although it is important that the tabs 63 not engage the underside of the latch plate 69, which would result in a substantial frictional loading, and represent inertia to be overcome in rotating the latch plate, the space between the underside of the latch plate 69 and the tabs 63 cannot be too great, because that space represents a "lost motion" in the valve train. In addition, even with the latch plate 69 in the latched condition, it is desirable to limit the rotation of the plate 69. With reference to FIG. 7, it may be seen that the underside of the latch plate 69 defines an edge (stop) surface 70 which limits rotation of the plate 69, by engagement with the tabs 63, when the tabs 63 are out of alignment with the arcuate openings 71. As a result of the surfaces 70 being disposed adjacent the tabs 63 and openings 71, the amount of travel of the latch plate 69 which must be accomplished by the actuator portion 51 will be fairly consistent, such that tolerances of the various parts do not adversely impact the operational requirements of the actuator portion 51.

Figure 2:
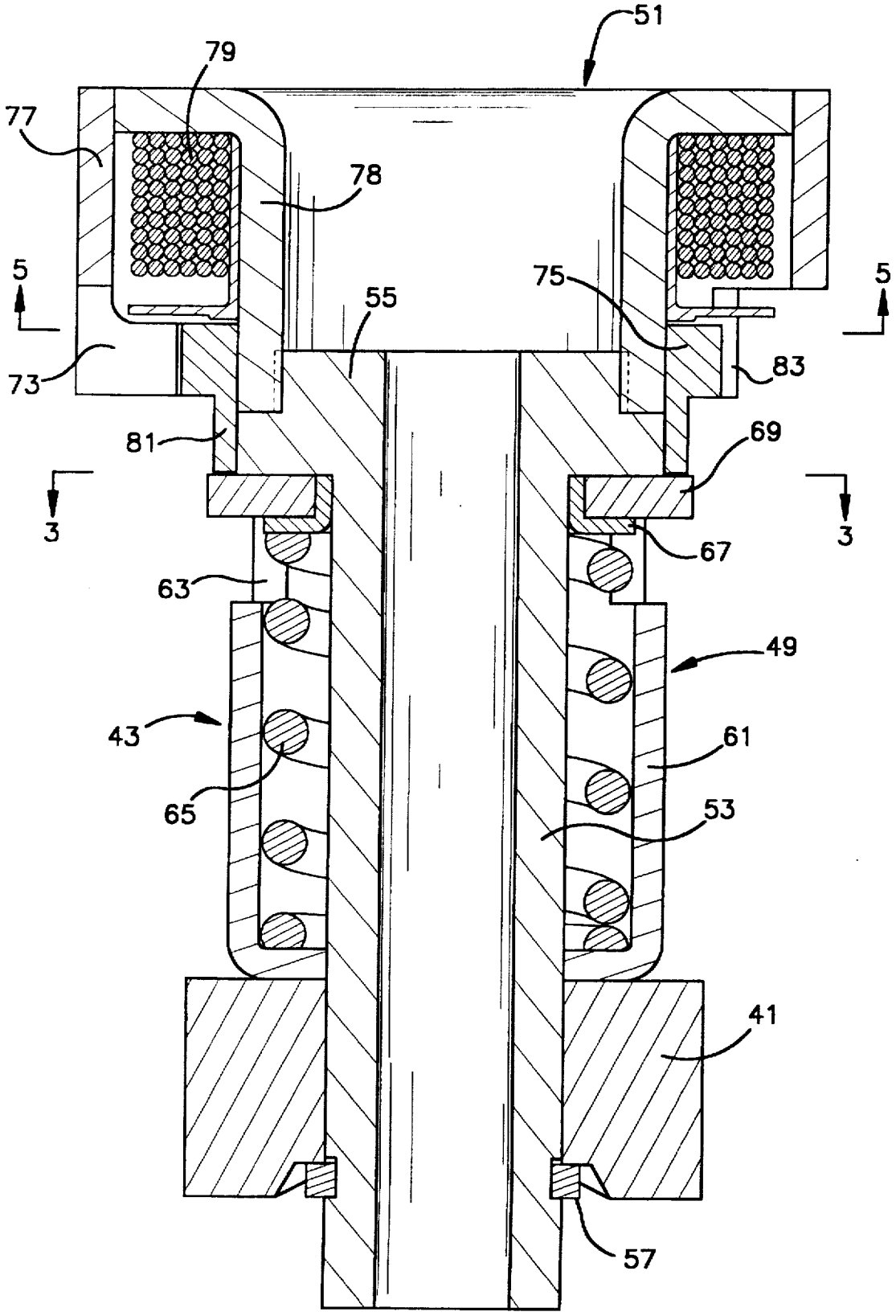
FIG. 2 is an enlarged, fragmentary, axial cross-section, similar to FIG. 1, of the valve deactivator of the present invention, shown in external plan view in FIG. 1.

Referring now to FIG. 3, in conjunction with FIG. 2, during normal operation of the engine, with the deactivator portion 49 in the latched condition, upward movement of the push rod 23 will initially cause the rocker arm 33 to pivot about the end 37, raising the central, pivot portion 39 of the rocker arm 33. This upward movement of the pivot portion 39 will, in turn, move the fulcrum 41 upward, thus moving the body member 61 upward until the lost motion is taken up, i.e., until the tabs 63 engage the undersurface of the latch plate 69. With the lost motion taken up, the central pivot portion 39 of the rocker arm 33 can no longer move upward, and the remaining upward movement of the push rod 23 is translated into downward movement of the poppet valve 29, in opposition to the force of the biasing spring 31, to achieve the normal, predetermined opening and closing of the valve 29.

Referring now to FIG. 4, in conjunction with FIG. 2, when it is desired to deactivate the valves, an appropriate signal is sent to the actuator portion 51, to be described in greater detail subsequently. The actuator portion 51 rotates the latch plate 69 from the latched condition shown in FIG. 3 to the unlatched condition shown in FIG. 4, wherein the arcuate openings 71 are aligned with, and adapted to receive the upwardly-extending tabs 63. As noted in the BACKGROUND OF THE DISCLOSURE, during this movement from "OFF" to "ON" (from latched to unlatched), the fuel injectors are being turned off, and preferably, both of these changes are effected during the ensuing revolution of the cam shaft 17, i.e., before the next engagement of the lift portion 25 and the lifter 21, i.e., while the lifter 21 is in engagement with the dwell portion 27 of the cam 19.

With the deactivator portion 49 now in the unlatched condition, and the fuel injectors turned off, upward movement of the push rod 23 will raise the end 35 of the rocker arm 33. In accordance with one important feature, the biasing force of the spring 31 must be greater than the biasing force of the spring 65 within the deactivator portion 49. Therefore, in the unlatched condition, upward movement of the end 35 will again cause the rocker arm 33 to begin to pivot about the end 37, but in the unlatched condition, there is nothing to limit upward movement of the pivot portion 39. As the pivot portion 39 moves upward, it also moves the fulcrum 41 and outer sleeve 59 upward, as well as the body member 61, and the tabs 63 move upward through the openings 71 in the latch plate 69, all such upward movement being in opposition to the force of the spring 65. However, because the spring 31 exerts a greater moment on the rocker arm 33 than does the spring 65, the rocker arm 33 continues to merely pivot about its end 37, and the tip of the poppet valve 29, without causing any downward movement of the valve 29.

After the lift portion 25 of the cam 19 passes out of engagement with the lifter 21, the spring 65 biases the body member 61, the fulcrum 41, and the rocker arm 33 downward to the position shown in FIG. 1 with the lifter 21 engaging the base circle 27 of the cam 19. As the cam shaft 17 rotates, the operation in the unlatched condition, as described above, is repeated until the deactivator portion 49 is again returned to the latched condition of FIG. 3.

Figure 5:
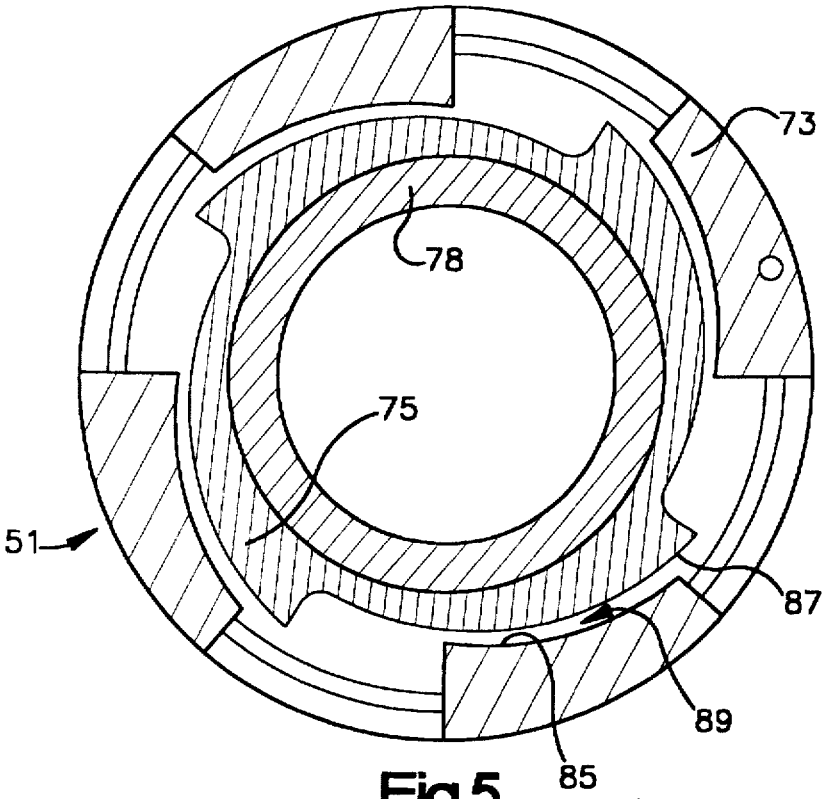
FIG. 5 is a transverse cross-section, taken on line 5—5 of FIG. 2, through the rotary actuator of the present invention, in a position corresponding to the normal, latched condition of the valve deactivator.

Referring now to FIG. 5, in conjunction with FIG. 2, the actuator portion 51 comprises an outer, stationary pole piece 73 and an inner, rotatable armature 75. Disposed radially between an upper cylindrical portion 77 of the pole piece 73 and an inner cylindrical portion 78 (shown only in FIG. 2), is an annular electromagnetic coil 79. Attached to the lower end of the armature 75 is a cylindrical member 81, the function of which is to transmit rotational motion of the armature 75 into corresponding rotation of the latch plate 69. This is accomplished by means of a pair of downwardly-extending tabs 82 (see FIGS. 3 and 4) which are received within mating slots in the outer periphery of the latch plate 69. Surrounding the cylindrical member 81 is a spiral return spring 83, having one end fixed relative to the pole piece 73, and the other end attached to either the latch plate 69 or the cylindrical member 81. In the subject embodiment, the return spring 83 biases the armature 75 and the latch plate 69 to the latched condition shown in FIGS. 3 and 5.

Figure 6:
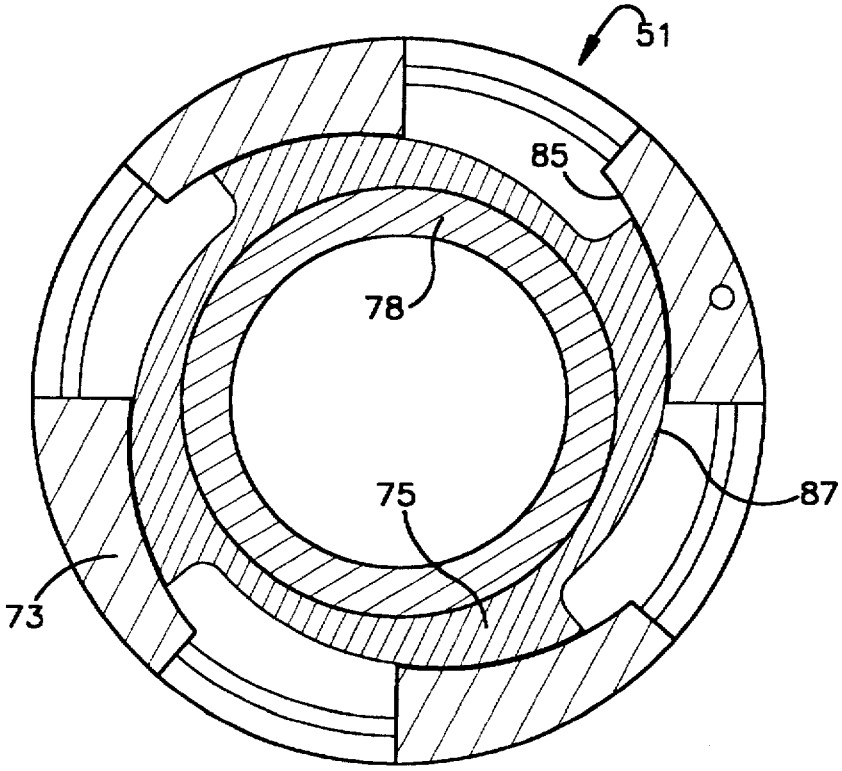
FIG. 6 is a transverse cross-section through the rotary actuator, in a position corresponding to the unlatched condition of the valve deactivator.

In accordance with another important aspect of the invention, the stationary pole piece 73 defines a pole surface or contour 85, while the rotatable armature 75 defines an armature surface or contour 87. Although not an essential feature of the invention, it is preferred that both of the contours 85 and 87 have a generally spiral configuration. Thus, with the armature 75 biased to the latched condition of FIGS. 5 and 7, the contours 85 and 87 define therebetween a radial air gap 89. When the coil 79 is energized, the result will be flux lines passing from the pole piece 73 into the armature 75 in an orientation which is both radial and tangential. As the armature 75 begins to rotate clockwise in FIG. 5 from the latched condition toward the unlatched condition of FIGS. 4 and 6, the continued rotation of the armature 75 is in opposition to an increasing biasing force exerted by the return spring 83. However, because of the spiral configuration of the contours 85 and 87, rotation of the armature 75 results in a decreasing air gap, thus increasing the density of the magnetic lines of flux, and increasing the torque on the armature 75.

In the subject embodiment, when the armature 75 has rotated sufficiently for the latch plate 69 to rotate to the unlatched condition of FIG. 4,. the armature contour 87 is in, or nearly in, contact with the pole contour 85, such that the air gap between the contours 85 and 87 is approaching zero, and the torque on the armature 75 is at a maximum.

The invention has been described in great detail in the foregoing specification, and it is believed that various alterations and modifications of the invention will become apparent to those skilled in the art from a reading and understanding of the specification. It is intended that all such alterations and modifications are included in the invention, insofar as they come within the scope of the appended claims.

I claim:

1. A valve deactivator assembly for an internal combustion engine of the type having valve means for controlling the flow to and from a combustion chamber, drive means for providing cyclical motion for opening and closing said valve means in timed relationship to the events in said combustion chamber, and valve gear means operative in response to said cyclic motion to effect cyclic opening and closing of said valve means; said valve deactivator assembly being of the type having a two-state latchable means movable between a latched position and an unlatched position, and operative in said latched position to provide normal predetermined opening and closing of said valve means, and operative in said unlatched position to effect lost motion of said valve gear means and effect opening and closing of said valve means by a predetermined amount which is less than said normal, predetermined opening and closing; said valve deactivator assembly including a latch member rotatably movable between said latched and said unlatched positions; characterized by:

(a) said valve deactivator assembly including an electromagnetic actuator having a stationary electromagnetic coil operable to generate magnetic lines of flux, a stationary pole piece, and a rotatable armature operable to rotate under the influence of said magnetic lines of flux;

(b) said rotatably movable latch member being fixed to rotate with said rotatable armature.

2. A valve deactivator assembly as claimed in claim 1, characterized by said valve gear means comprises a rocker arm having a first end in engagement with said drive means to receive said cyclical motion therefrom, and a second end in engagement with said valve means to impart said opening and closing motion thereto, said rocker arm further including a pivot portion, disposed intermediate said first and said second ends, said pivot portion being fixed for substantially only pivotal movement when said latchable means is in said latched position.

3. A valve deactivator assembly as claimed in claim 1, characterized by said assembly including a crenellated cup member being normally biased by a biasing means toward its latched position, when said latch member is in said latched position.

4. A valve deactivator assembly as claimed in claim 1, characterized by said latchable means being operable in said unlatched position to effect sufficient lost motion whereby said opening and closing of said valve means is substantially zero.

5. A valve deactivator assembly as claimed in claim 1, characterized by said stationary pole piece defines a pole contour, and said rotatable armature defines an armature contour, said pole contour and said armature contour being configured such that when said armature is in a first position, corresponding to said latched position, said contours define a first air gap, and that when said armature is in a second position, corresponding to said unlatched position, said contours define a second air gap, said first air gap being substantially greater than said second air gap.

6. A valve deactivator assembly as claimed in claim 5, characterized by said pole contour comprises a generally spiral shape, and said armature contour comprises a generally spiral shape, whereby said magnetic lines of flux, passing through the air gap, are oriented generally radially, but include a tangential component.

7. A valve deactivator assembly as claimed in claim 1, characterized by said means operable to define a space having a fixed vertical height, and said movable latch member is generally annular, is received within said space, and has a thickness less than said vertical height, whereby said latch member is freely rotatable between said latched and said unlatched positions.

8. A valve deactivator assembly as claimed in claim 7, characterized by said assembly including biasing means biasing said latch member toward said latched position, in the absence of actuation of said electromagnetic actuator.

9. A valve deactivator assembly as claimed in claim 7, characterized by said latch member defining a stop surface disposed to engage a non-rotatable portion of the assembly, thereby limiting rotation of the latch member when said latch member is in said latched position.

10. A valve deactivator assembly as claimed in claim 7, characterized by said means operable to define said space comprising a cage member including both a cylindrical portion, defining said space axially, and a radially extending portion, said assembly including a crenelated cup member, said radially extending portion of said cage member being disposed within said cup member and operable to locate said cup member radially.

11. A valve deactivator assembly as claimed in claim 1, characterized by said assembly including a centrally disposed shaft member defining at least one flat surface, and a fulcrum member defining a mating flat surface operable to engage said flat surface defined by said shaft member for proper rotational alignment between said shaft member and said fulcrum member.

* * * * *